United States Patent [19]

Sinchok et al.

[11] Patent Number: 4,723,679

[45] Date of Patent: Feb. 9, 1988

[54] TRAY OR TOTE BOX COLLAR EXTENSION

[76] Inventors: John D. Sinchok, N 8065 Lac LaBelle Dr.; Paul R. Gora, N 8072 Lasalle Cir., both of Oconomowoc, Wis. 53066

[21] Appl. No.: 871,834

[22] Filed: Jun. 9, 1986

Related U.S. Application Data

[63] Continuation-in-part of Ser. No. 834,582, Feb. 28, 1986, abandoned.

[51] Int. Cl.[4] ..... B65D 6/24

[52] U.S. Cl. ..... 220/4 A; 220/4 F; 220/319; 220/320

[58] Field of Search ..... 220/4 A, 4 F, 319, 320

[56] References Cited

U.S. PATENT DOCUMENTS

| | | |
|---|---|---|
| 848,698 | 4/1907 | Smith . |
| 2,530,481 | 11/1950 | Rawn, Jr. . |
| 2,549,013 | 4/1951 | Robles et al. . |
| 2,878,956 | 3/1959 | Chovanes . |
| 3,101,154 | 8/1963 | Herdering . |
| 3,179,277 | 4/1965 | Olson et al. . |
| 3,333,722 | 8/1967 | Panknin . |
| 3,547,300 | 12/1970 | Studinski et al. . |
| 3,599,823 | 8/1971 | Morris et al. . |
| 3,647,101 | 3/1972 | Hensch et al. . |
| 3,672,530 | 6/1972 | Bridenstine et al. . |
| 3,693,823 | 9/1972 | Rehrig . |
| 3,744,671 | 7/1973 | Saunders, Jr. . |
| 3,883,005 | 5/1975 | Stevens . |
| 4,095,719 | 6/1978 | Wolf . |
| 4,113,131 | 9/1978 | Joseph . |
| 4,176,756 | 12/1979 | Gellman . |
| 4,314,649 | 2/1982 | Blomqvist . |
| 4,347,941 | 9/1982 | Johansson et al. . |
| 4,457,445 | 7/1984 | Hanks et al. . |
| 4,460,214 | 7/1984 | Kuhns . |
| 4,466,549 | 8/1984 | Hanaway . |

*Primary Examiner*—George E. Lowrance
*Attorney, Agent, or Firm*—Quarles & Brady

[57] ABSTRACT

An extension collar for a container tray or box which can be readily fitted onto the container and afford varying height extensions for the container. The collar has side members which are first positioned on the top rim of the container and subsequently the end members are attached to the previously positioned collar members by means of projections. The projections have barbed ends positioned either vertically or horizontally for fitting into the previously positioned collar members having a latch arrangement for receiving them. The collar members have flanges for a loose positioning of the collar members on the top rim of the container and are preferably in the form of a flange on one side of the member for engagement with the rim and an opposing hook portion for fitting underneath a projecting wall portion of the rim. The collars can range in height, preferably from one inch to four inches, depending upon the height desired in the extension.

11 Claims, 10 Drawing Figures

FIG. 8
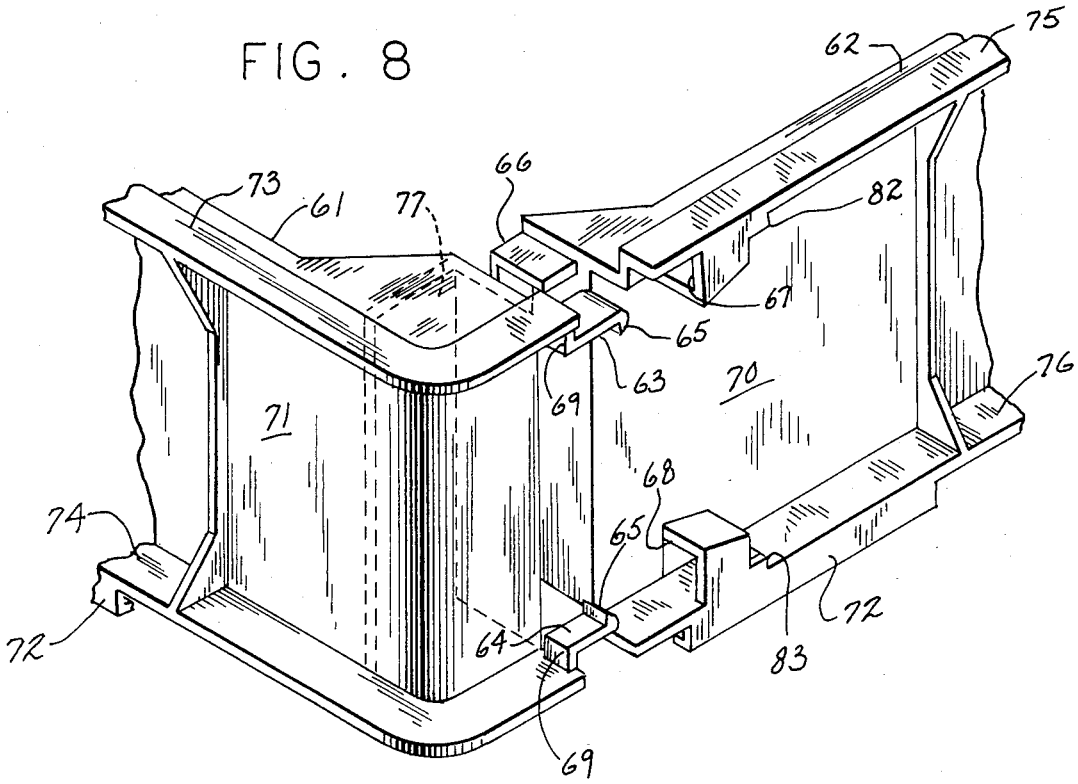
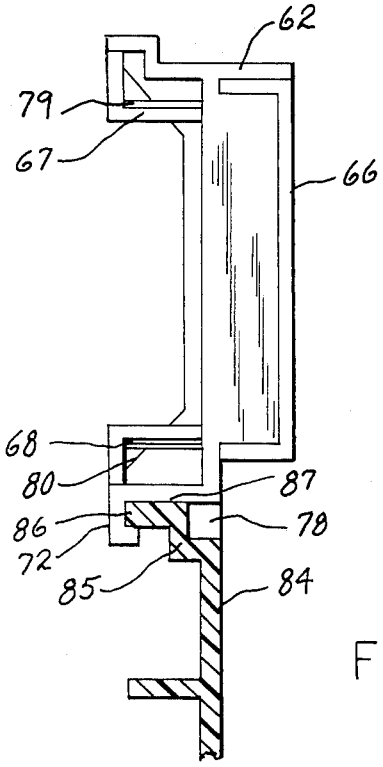
FIG. 9
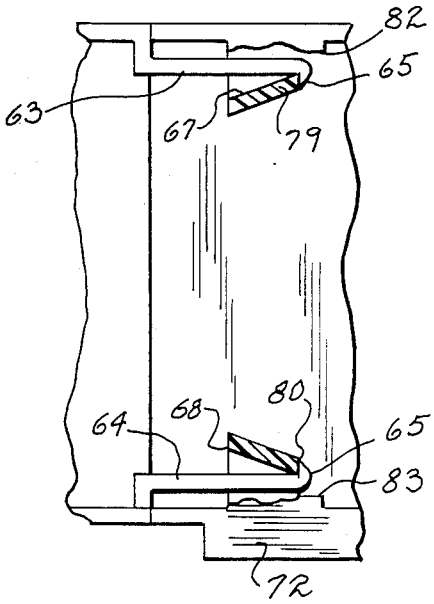
FIG. 10

TRAY OR TOTE BOX COLLAR EXTENSION

CROSS-REFERENCE TO RELATED APPLICATIONS

This application is a continuation-in-part of application Ser. No. 834,582, filed Feb. 28, 1986, now abandoned.

BACKGROUND OF THE INVENTION

This invention relates to collar extensions for containers such as trays and tote boxes. More particularly, the invention relates to collar extensions of the foregoing type which have the same number of collar members as the sides and ends of each container and are positioned in a loose manner prior to their being interfitted with projecting members and latch bars.

Trays and tote boxes are designed for handling different sizes of commodities. It is difficult to design a standard type container for all sizes of each commodity. For efficiency purposes it is highly desirable if certain size containers could be converted to a larger size in order to accommodate different sizes and amounts of commodities.

An example of a tray collar combination is set forth in U.S. Pat. No. 3,672,530. While the extension collar proposed in this particular patent is adapted to be positioned on the existing tray, it has its shortcomings in that it requires a locking means which requires a high degree of flexing in one embodiment or the rotation of another element in another embodiment in order to fix the collar onto the tray. In U.S. Pat. No. 4,347,941, a pallet collar with hinges at the corners is utilized and is indicated by the reference numeral 3. In this particular collar version there are rib portions 21 intended to carry a removeable bottom (not shown) and provide a form stable open case. In U.S. Pat. No. 4,095,719 a particular edge extrusion is provided for attachment to a peripheral rim of a plastic container sidewall.

The prior art does not provide an extension collar which can be readily fitted onto various sizes of containers with a minimum amount of effort yet utilizes a minimum number of component parts which can be stored therein. Neither does the prior art provide an extension collar of the foregoing type which at the same time obviates the fabrication of close fitting components.

It is an advantage of the present invention to provide an extension collar for a container which is readily adaptable to be positioned on the container and retained thereon in a secure manner. Another advantage is a collar of the foregoing type where collar members are prepositioned in a loose-fitting manner on a container surface and then secured thereon by a snap fit arrangement. Yet another advantage is an extension collar which can be readily removed from the container without loosening connecting parts and easily stored in the container. Other advantages of this invention are an extension collar of the foregoing type which can be manufactured without close tolerances yet does not require a high degree of flexing of the inner-fitting portions thus reducing cost in the manufacture yet ease in the use thereof.

SUMMARY OF THE INVENTION

The foregoing advantages are accomplished and the shortcomings of the prior art are overcome by the present extension collar as well as its method of use. The collar is intended to be used with a pallet tray or tote box which has a rim with a supporting surface and spaced apart surfaces overlying the periphery thereof. The extension collar has separable collar members which extend over and rest on the rim surface to provide an extension of height for the container. Each of the collar members has opposing and extending flange portions to engage opposing sides of the rim. they are also connected by a snap fitment means. At least one projecting member extends from opposing ends of some of the collar members and at least one receiving member for the projecting member is constructed and arranged on a collar member opposite said projecting member to receive the projecting member in a friction fit manner. In a preferred manner, the extension collar includes four collar members to be positioned above two sidewalls and tow end walls of the container. Also preferably, some of the flange portions for contacting the rim of the container are defined as hooks extending from and fitting under the container rim. Also in a preferred manner the projecting members include a barbed end portion which can be disposed in either a transverse or parallel plane with respect to the rim of the tote box and are snap-fitted onto a latch bar or wall surface disposed in corresponding transverse or parallel planes. To assist in the snap-fit arrangement of the projections onto the latching surfaces the collar member with the latching surface has a guide portion which also serves to interengage with an extension or pocket of the collar member having the projecting member.

BRIEF DESCRIPTION OF THE DRAWINGS

A better understanding of the present extension collar will be accomplished with reference to the drawings wherein:

FIG. 8 is a view similar to FIG. 2 showing an additional alternative embodiment of the extension collar.

FIG. 9 is a view similar to FIG. 6 illustrating the embodiment of FIG. 8.

FIG. 10 is a view similar to FIG. 3 but showing the embodiment of FIG. 8.

DESCRIPTION OF THE PREFERRED EMBODIMENT

Figure 1:
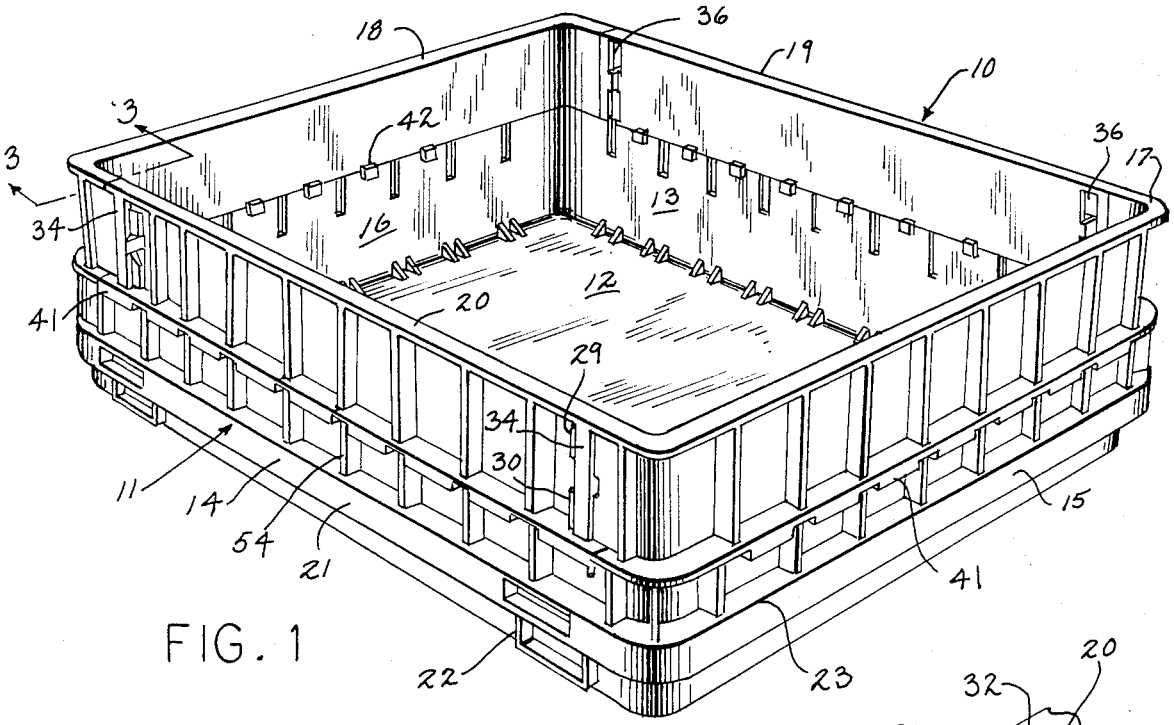
FIG. 1 is a top perspective view of the extension collar as it is positioned on a tray.

Proceeding to a detailed description of the present invention, the extension collar generally 10 is shown in FIG. 1 assembled on a pallet tray generally 11. The pallet tray in this instance has the usual bottom wall 12 sidewalls 13 and 14 and end walls 15 and 16 extending upwardly from the bottom wall to provide an open container. The particular container includes a unique bumper rim 21 with stacking stops 22 as described in U.S. Pat. No. 4,499,997 and commonly assigned. As best seen in FIG. 1, the extension collar 10 includes collar members 17 and 18 for placement over end walls 15 and 16 as well as collar members 19 and 20 for placement over side walls 13 and 14. The collar members will be positioned over the rim 23 of the collar tray and positioned directly on an upper rim supporting surface 24 (See FIG. 7).

Figure 2:
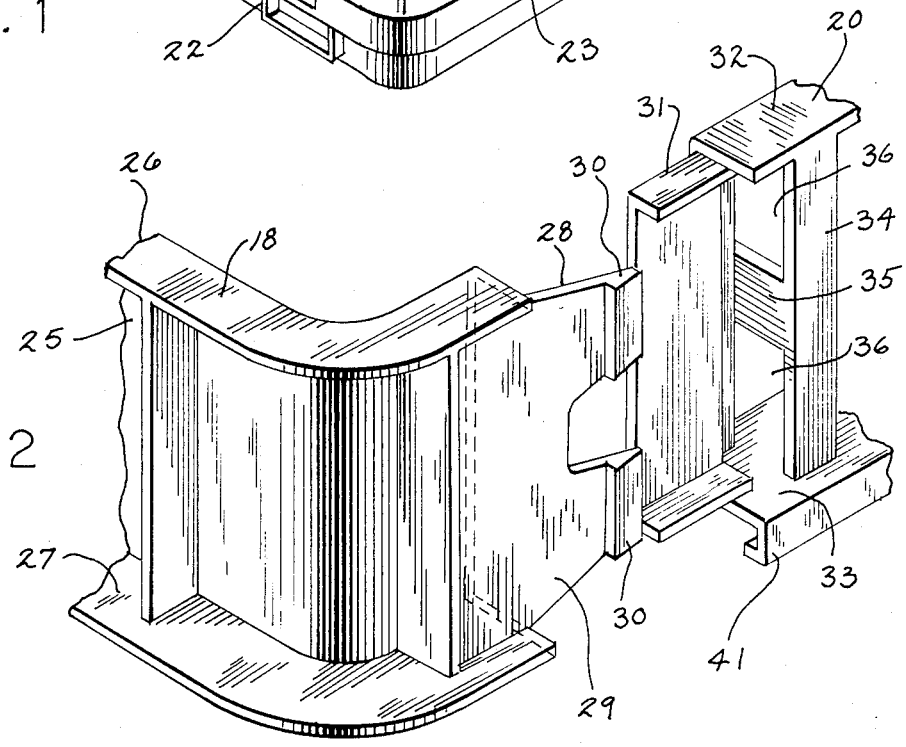
FIG. 2 is an enlarged and partial assembly view showing the alignment of two of the collar members before they are engaged.

As best seen in FIG. 2, collar member 18 includes a wall portion 25 with upper and lower rims 26 and 27. Extending from wall 25 are projections 28 and 29 having barbed end portions 30. These barbed end portions 30 are guided by the "U" shaped guide portion 31 extending from the collar member 20. They are adapted to be received through the openings 36 as defined by the cross member 35 and for engagement at the opposing side of the latch bar 34. The collar member 20 also has an upper rim 32 and a lower rim 33 for abutment with rims 26 and 27 respectively.

Figure 3:
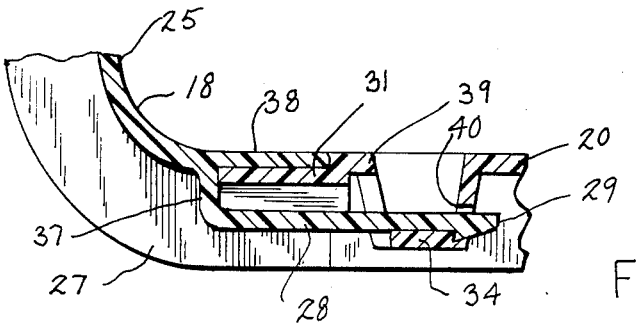
FIG. 3 is a view in horizontal section taken along line 3—3 of FIG. 1 and illustrating the interengagement of two of the collar members.

As best seen in FIG. 3, the projection 28 (as is true of projection 30) is interconnected with the wall 25 by the transverse extending section 37. An extension 38 is also integrally formed with the wall 25 and is accommodated in a coplanar fashion with collar member 20 by the offset guide portion 31. The wall 39 provides a stop for extension 38. As further seen in FIG. 3 a further restriction of opening 36 is provided by extending wall 40 for the purpose of holding barbed portions 28 and 29 against latch bar 34.

Figure 7:
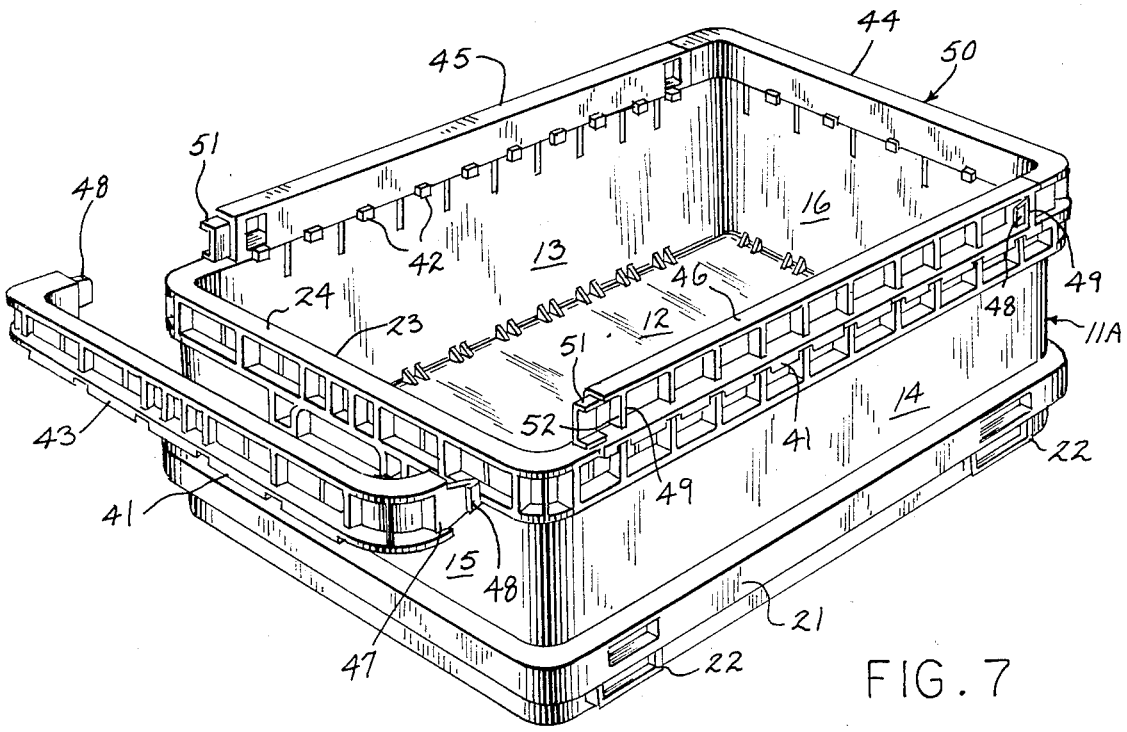
FIG. 7 is a view similar to FIG. 1 showing an alternative embodiment of the extension collar.

An alternative embodiment of the extension collar is shown in FIG. 7 and indicated generally by the number 50. This embodiment includes collar members 43, 44, 45 and 46 which are adapted to be positioned over end walls 15 and 16 as well as sidewalls 13 and 14, respectively. In this particular embodiment, single projections 47 with a barbed end portion 48 are utilized and extend from opposing ends of the collar members 43 and 44. They pass through opening 52 for engagement with the opposing side of the latch bars 49. Extension collar 50 is indicated for use with the tote box 11A which will be of a larger height than the pallet tray 11 indicated in FIG. 1. It will, however, have the same bumper rim structure 21 and the stacking stops 22.

Another alternative embodiment of the extension collar is shown in FIGS. 8, 9 and 10 and indicated generally by the number 60. This embodiment has two projections 63 and 64 extending from the collar member 61. The projections 63 and 64 extend from the collar member 61 by the transverse extensions 69. They have the barbed end portions 65 which are disposed with their longitudinal dimensions parallel to the rims 73 and 74 of the collar member 61 as well as the rim of a container such as rim support surface 24 of pallet tray 11A when placed thereon. This is a major difference with respect to the previously described extension collars 10 and 50 wherein the longitudinal dimension of the barbed end portions 30 and 48 are transverse with respect to the rim support surface 24. Vertically inclinde guide ramps 67 and 68 extend from collar member 62 to receive the barbed end portions 65. A U-shaped projection 66 extends from collar member 62 for slidable contact in a U-shaped compartment or pocket 77 disposed in the collar member 61. It is further seen that the collar members 61 and 62 have the walls 70 and 71 extending between the rims 73, 74 and 75, 76.

Referring specifically to FIG. 9, a rim 84 is shown for either pallet tray 11 or 11A which is different from the rim 23. In this instance the rim 84 has a step 85 and a ledge 86. A flange 78 extends from the collar 62 and is of a geometrical configuration to complement the step 85. The previously described hook 72 is spaced from the flange 78 to engage the ledge 86.

As best seen in FIG. 10, the projections 63 and 64 are of sufficient length so that when rim-portions 73, 75 and 74, 76 abutt, the barbed end portions 65 will engage the latching wall surfaces 79 and 80. As further seen in FIG. 10, nubs 82 and 83 are positioned in a spaced manner with respect to latching wall surfaces 79 and 80 for the purpose of retaining barbed end portions 65 against the latching wall surfaces 79 and 80.

OPERATION

Figure 4:
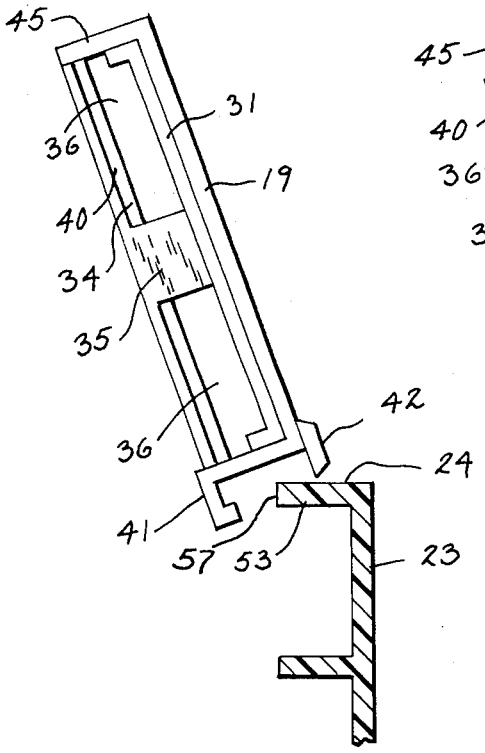
FIGS. 4, 5 and 6 are assembly views depicting the placement of one of the collar members onto the upper rim surface of a container and prior to their interengagement.
Figure 5:
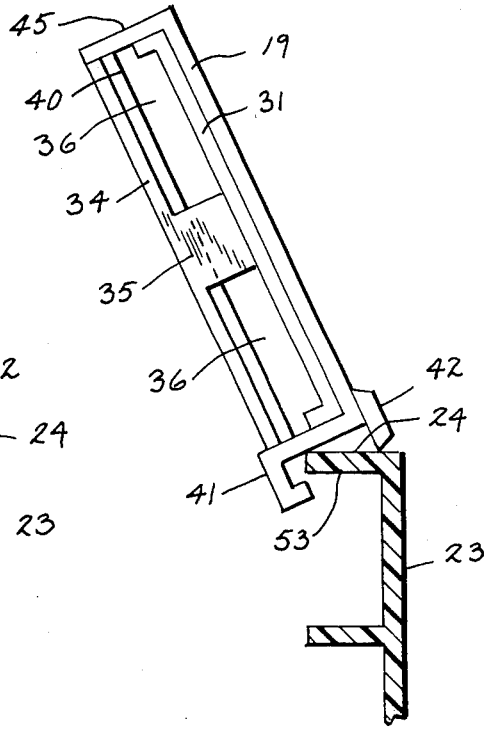
Figure 6:
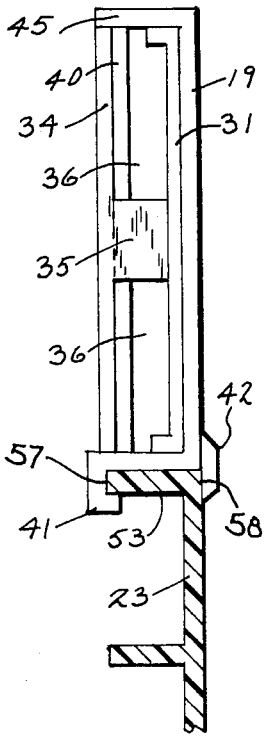

The extension collar 10 of this invention is further described in conjunction with its operation. In many instances, it is desired to have a pallet tray 11 which is of a relative short height extended to additional height such as, for example, three inches. In this instance, collar 10 is utilized on the top of the pallet tray 11. The side collar members 19 and 20 are placed thereon initially. For example, the collar member 19 is initially positioned over the rim surface 24 by aligning the hook portion 41 and flange portion 42 as shown in FIG. 4 and in offset manner. A further tilting and movement of the collar member 19 as indicated in FIG. 5 places the hook portion 41 under the rim surface 24. The collar member 19 is then moved to a more upright position as shown in FIG. 6 with flange portion 42 disposed to the inside of the rim structure 23 and the hook portion 41 surrounding the opposite side of the rim ledge 53. In this position, the hook 41 engages one surface 57 of the rim ledge 53 while the flange portion 42 engages a spaced apart engaging surface 58. Collar 19 will then be supported on the supporting surface 59 of the rim ledge 53. The collar member 20 will be similarly attached to the rim ledge 53. In this position, collar members 19 and 20 are restrained from moving upwardly or from side to side. However, limited movement along the longitudinal axis of rim 23 can be effected and will be restrained when a hook portion 41 engages a supporting rib 54 of the pallet tray 11 (See FIG. 1). When both side collar members 19 and 20 are in the position indicated in FIG. 6, the end collar members 17 and 18 are aligned therewith and over the rim ledge 53 of the end walls 15 and 16. They are also positioned in an offset manner such as indicated in FIGS. 4–6 for the side collar members. The paired barbed end portions 30 of projections 28 and 29 are orientated for passage along the guide portions 31 and for passage of the barbed end portions 30 behind the latch bars 34 until they engage the opposing surface of the latch bar as indicated in FIG. 3. This results in a snap-fit arranagement as well as with the extension 38 being seated against offset guide portion 31. This interengagement of the end collar members 17 and 18 with the side collar members 19 and 20 is aided in part by the absence of hook portions 41 at the corners. This is designated by the numeral 55. This aspect in combination with the pallet tray being formed of a flexible plastic material allows the collar members to move from $\frac{1}{8}''$ to 1/16" for latching purposes.

It will be appreciated that collar members 17 and 18 have two pairs of barbed end portions at opposing ends thereof to engage side collar members 19 and 20. This is indicated in the embodiment shown in FIG. 1. With the barbed end portions 30 positioned in contact with the latch bars 34 of the collar members 19 and 20 all of the collar members 17–20 assume an upright position as shown in FIG. 1 with the hook portions 41 and the flange portions 42 positioned on opposing sides of the rim ledge 53.

The positioning and attaching of the extension collar 50 will be in the same manner as indicated for extension collar 10 except that only single and opposite barbed end portions 48 are aligned along the guide portions 51 for engagement with the opposing sides of the latch bars 49 on the collar members 45 and 46.

The positioning and attaching of the extension collar 60 is essentially in the same manner as described for collar 10. Instead of a vertical latching between the projections 28, 29 and the latch bar 34, there is instead a horizontal latching between projections 63, 64 and wall surfaces 79, 80. This latching is effected by the diverging movement of the barbed end portions 65 as they move over the inclined guide ramps 67 and 68. Additional guidance is accomplished by the projection 66 passing into the compartment 77. As indicated with respect to the previous embodiments two collar members 61 will be positioned over the end walls 15 and 16 of the trays 11 and 11A and two collar members 62 will be positioned over the side walls 13 and 14. They will be initially positioned thereover in the same manner as indicated in FIGS. 4–6. As best seen in conjunction with FIG. 9 and collar member 62, hooks 72 will engage the outside surface of rim ledge 86 and flange 78 an inside surface. The collar member 62 is supported on the supporting surface 87 of the rim 84. This is the same positioning as previously described in conjunction with FIG. 6.

To disassemble any of the extension collars 10, 50 or 60, all that is required in the instance of collars 10 or 50 is a displacement of the barbed end portions 30 or 48 inwardly and away from the latch bar 34 or 49 and in the instance of collar 60 a displacement of the barbed end portions 65 inwardly and away from the wall surfaces 79 and 80. This is followed by a tilting of the end collar members 17, 18; 43, 44; 61 first and the collar members 19, 20; 45, 46; 62 thereafter. The tilting is in a reverse manner as indicated in FIGS. 4 and 5. With the collar members removed from the upper rim ledge 53 they can be easily stored within the pallet tray 11 or the tote box 11A. They are then readily available for subsequent use.

The preferred materials for injection molding the collar extensions 10, 50 and 60 is polyethylene and polypropylene. However, ABS or other similar thermoplastic materials could also be used. In the instance of collar member 50, it is of a one-inch height with single barbed end portions 48. Obviously the extension collars can be of various heights as indicated by extension collar 10 which preferably is of a three-inch height and can have any number of opposing extension projections such as indicated by the projections 28 and 29. While the extension collars have been advantageously described in conjunction with a pallet tray 11 or a tote box 11A, the extension collars can be readily employed in conjunction with any size tray or container having various wall heights or lengths. The guide portion 31 is shown as being U-shaped. As indicated in FIG. 3, it can function as a guide without the end flanges.

It will thus be seen that through the present invention there is now provided extension collars which can be readily attached to and removed from the container in a fast and efficient manner. The extension collar when disassembled is readily stored in the container. In the instance where different size containers or trays have the same widths for the end walls but varying lengths for the sidewalls, only the different sized side collar members need to be provided as the same end wall collar members can be utilized in both instances. Thus, substantial cost savings is effected as well as versatility in design of the collar members to accommodate various sizes of containers or trays.

While only certain preferred features of the invention have been shown by way of illustration, many modifications and changes will occur to those skilled in the art. It is, therefore, to be understood that the appended claims are intended to cover all of its modifications and changes that fall within the true spirit of the invention.

What is claimed is:

1. An extensnion collar for a container such as a pallet tray or tote box having side and end walls and a rim with a supporting surface, said rim having spaced apart opposing engaging surfaces surrounding the periphery thereof, comprising:

separable collar members adapted to be placed over said supporting surface of said rim to provide a height extension of said container, a first pair of said collar members for placement on said rim of said side walls and a second pair of said collar members for placement on said rim of said end walls, each of said collar members having an opposing unitary flange portion to engage said opposing engaging surfaces of said rim at one side and a rigid hook portion for placement under said rim from an opposing side, said flange and hook portions spaced apart in a manner to provide placement of said collar members on said supporting surface by a lateral displacement of said collar members followed by an upright positioning and further followed by a longitudinal movement of at least some of said collar members over said supporting surface;

at least one unitary projecting member extending from opposing ends of some of said collar members; and at least one unitary receiving member for said projecting member constructed and arranged on other said collar members opposite said projecting member to receive said projecting member in a friction fit manner.

2. The invention according to claim 1 wherein said pairs of extension collars include four said collar members.

3. The invention according to claim 2 wherein one pair of said collar members are constructed and arranged to be positioned over the rim of end walls of said container and said projections are disposed on said one pair of collar members.

4. The invention according to claim 3 wherein said collar members with said projections have a pair of said projections extending therefrom and the remaining collar members have a pair of said receiving members for said projections.

5. The invention according to claim 1 wherein said projecting member includes a barbed end portion and said receiving member includes a wall contact surface for said barbed end portion.

6. The invention according to claim 5 wherein said wall contact surface is defined by a latch bar member.

7. The invention according to claim 6 wherein said collar members include guide surfaces to position said barbed end portion in contact with said latch bar member.

8. The invention according to claim 7 wherein said guide surface terminates in a wall engaging stop for contact with another collar member.

9. The invention according to claim 5 wherein said barbed end portion and said wall contact surface have engaging portions which extend in a plane generally transverse to the plane of said rim of said tote box.

10. The invention according to claim 5 wherein said barbed end portion and said wall contact surface have engaging portions which extend in a plane generally parallel to the plane of said rim of said tote box.

11. The invention according to claim 10 wherein said collar members include inclined guide surfaces to position said barbed end portions in contact with said wall contact surface.

* * * * *

UNITED STATES PATENT AND TRADEMARK OFFICE

CERTIFICATE OF CORRECTION

PATENT NO. : 4,723,679

DATED : February 9, 1988

INVENTOR(S) : John D. Sinchok et al.

It is certified that error appears in the above-identified patent and that said Letters Patent is hereby corrected as shown below:

| | |
|---|---|
| Column 2, line 8 | "they" should read --They-- |
| Column 2, line 17 | "tow" should read --two-- |
| Column 3, line 57 | "inclinde" should read --inclined-- |
| Column 6, line 14 | "extensnion" should read --extension-- |

Signed and Sealed this

Twentieth Day of September, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,723,679

DATED : February 9, 1988

INVENTOR(S) : John D. Sinchok et al

It is certified that error appears in the above-identified patent and that said Letters Patent is hereby corrected as shown below:

On the title page Insert

--(73) Assignee: Menasha Corporation, Neenah, Wisconsin--.

Signed and Sealed this

Twenty-third Day of May, 1989

*Attest:*

*Attesting Officer*

DONALD J. QUIGG

*Commissioner of Patents and Trademarks*